US008317196B2

(12) United States Patent
Tanaka et al.

(10) Patent No.: US 8,317,196 B2
(45) Date of Patent: Nov. 27, 2012

(54) MEDIUM CONVEYING DEVICE AND IMAGE FORMING APPARATUS

(75) Inventors: Toshitaka Tanaka, Kanagawa (JP); Michio Tada, Kanagawa (JP); Takashi Abe, Kanagawa (JP); Yousuke Hasegawa, Kanagawa (JP); Hisakazu Onoe, Kanagawa (JP); Hiroyuki Suzuki, Kanagawa (JP); Akira Iwasaka, Kanagawa (JP); Makio Uehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/956,585

(22) Filed: Nov. 30, 2010

(65) Prior Publication Data

US 2011/0140343 A1 Jun. 16, 2011

(30) Foreign Application Priority Data

Dec. 14, 2009 (JP) ..... 2009-283356

(51) Int. Cl.
*B65H 5/02* (2006.01)
*G03G 21/00* (2006.01)

(52) U.S. Cl. ..... 271/273; 399/124

(58) Field of Classification Search ..... 271/273, 271/272; 399/124

See application file for complete search history.

(56) References Cited

U.S. PATENT DOCUMENTS

| | | | | |
|---|---|---|---|---|
| 4,570,923 | A * | 2/1986 | Hooper et al. | 271/275 |
| 5,205,551 | A * | 4/1993 | Nagano et al. | 271/225 |
| 6,145,828 | A * | 11/2000 | Arai | 271/3.03 |
| 7,168,701 | B2 * | 1/2007 | Isaka et al. | 271/273 |
| 7,245,855 | B2 * | 7/2007 | Yasumoto | 399/124 |
| 7,950,659 | B2 * | 5/2011 | Matsushima | 271/264 |

FOREIGN PATENT DOCUMENTS

| | | |
|---|---|---|
| JP | A-11-143156 | 5/1999 |
| JP | A-2005-255413 | 9/2005 |
| JP | A-2006-52033 | 2/2006 |
| JP | A-2009-062201 | 3/2009 |

* cited by examiner

*Primary Examiner* — Kaitlin Joerger
(74) *Attorney, Agent, or Firm* — Oliff & Berridge, PLC

(57) ABSTRACT

A medium conveying device includes a first guide member, a second guide member, a conveying member, and a support member. The first guide member guides one face of a medium to be conveyed and opposed to the one face when the medium is conveyed. The second guide member guides the other face of the medium and is opposed to the other face when the medium is conveyed, the second guide member being movable between a close position and an open position. The conveying member is provided in a conveying passage formed by the first guide member and the second guide member being at the close position in order to convey the medium in the conveying passage. The support member keeps the second guide member at the open position and is provided at a position outer than the second guide member in a direction that the medium is conveyed. When the second guide member is at the open position, the medium in the conveying passage is removable from the conveying passage.

10 Claims, 10 Drawing Sheets

MEDIUM CONVEYING DEVICE AND IMAGE FORMING APPARATUS

CROSS-REFERENCE TO RELATED APPLICATIONS

This application is based upon and claims priority under 35 USC 119 from Japanese Patent Application No. 2009-283356, filed Dec. 14, 2009.

BACKGROUND

Technical Field

This invention relates to a medium conveying device and an image forming apparatus.

SUMMARY OF THE INVENTION

According to an aspect of the invention, a medium conveying device includes a first guide member, a second guide member, a conveying member, and a support member. The first guide member guides one face of a medium to be conveyed and opposed to the one face when the medium is conveyed. The second guide member guides the other face of the medium and is opposed to the other face when the medium is conveyed, the second guide member being movable between a close position and an open position. The conveying member is provided in a conveying passage formed by the first guide member and the second guide member being at the close position in order to convey the medium in the conveying passage. The support member keeps the second guide member at the open position and is provided at a position outer than the second guide member in a direction that the medium is conveyed. When the second guide member is at the open position, the medium in the conveying passage is removable from the conveying passage.

BRIEF DESCRIPTION OF THE DRAWINGS

Exemplary embodiments of the invention will be described in detail based on the following figures, wherein:

FIG. 5A is a schematic representation of a state in which the relay conveying unit is moved to a closed position, and FIG. 5B is a schematic representation of a state in which the relay conveying unit is moved to an open position;

FIG. 6A is a schematic representation of a state in which the relay conveying unit is moved to a closed position, and FIG. 6B is a schematic representation of a state in which the relay conveying unit is moved to an open position;

FIG. 7A is a main part schematic representation of a one end support member, and FIG. 7B is a main part schematic representation of an opposite end support member;

FIG. 8A is a perspective view, and FIG. 8B is a sectional view taken on line VIIIB-VIIIB in FIG. 8A;

DETAILED DESCRIPTION

Figure 1:
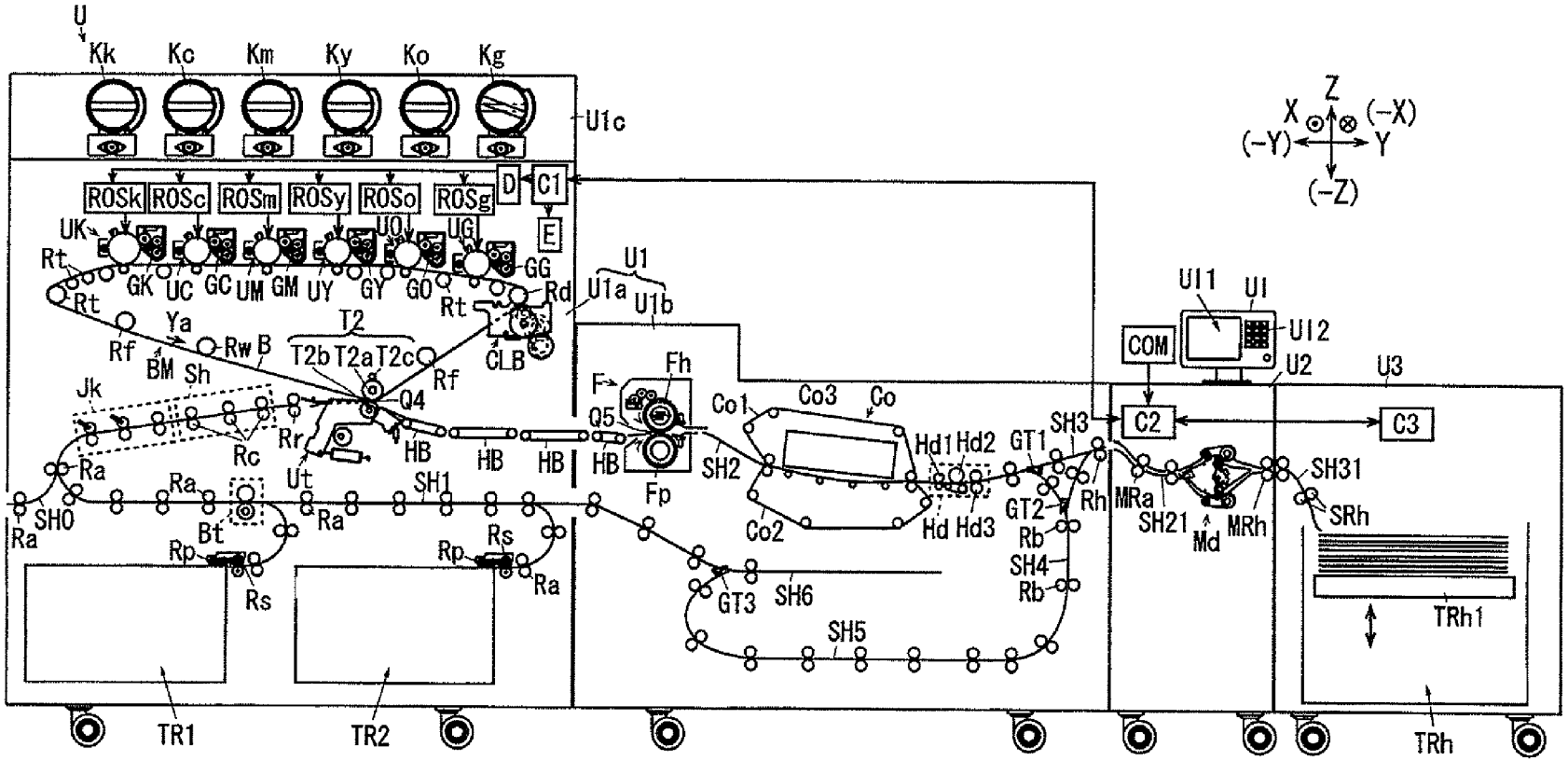
FIG. 1 is a general schematic representation of a printer of Exemplary Embodiment 1 of the invention.

Exemplary embodiments as specific examples of the mode for carrying out the invention will be discussed with reference to the accompanying drawings. However, the invention is not limited to the following exemplary embodiments.

For easy understanding of the description to follow, in the accompanying drawings, back and forth direction is X axis direction, side to side direction (left-right direction) is Y axis direction, and up and down direction is Z axis direction, and directions or sides indicated by arrows X, −X, Y, −Y, Z, and −Z are forward, backward, rightward, leftward, upward, and downward or front, rear (back), right, left, upper side (top), and lower side (bottom).

In the accompanying drawings, a mark including a dot described in a circle means an arrow from the back of the plane of the drawing to the surface and a mark including X described in a circle means an arrow from the surface of the plane of the drawing to the back.

In the description that follows using the accompanying drawings, members other than the members required for the description are not shown in the drawings where appropriate for easy understanding of the description.

Exemplary Embodiment 1

Description of Printer U of Exemplary Embodiment 1

FIG. 1 is a general schematic representation of a printer of Exemplary Embodiment 1 of the invention.

Figure 2:
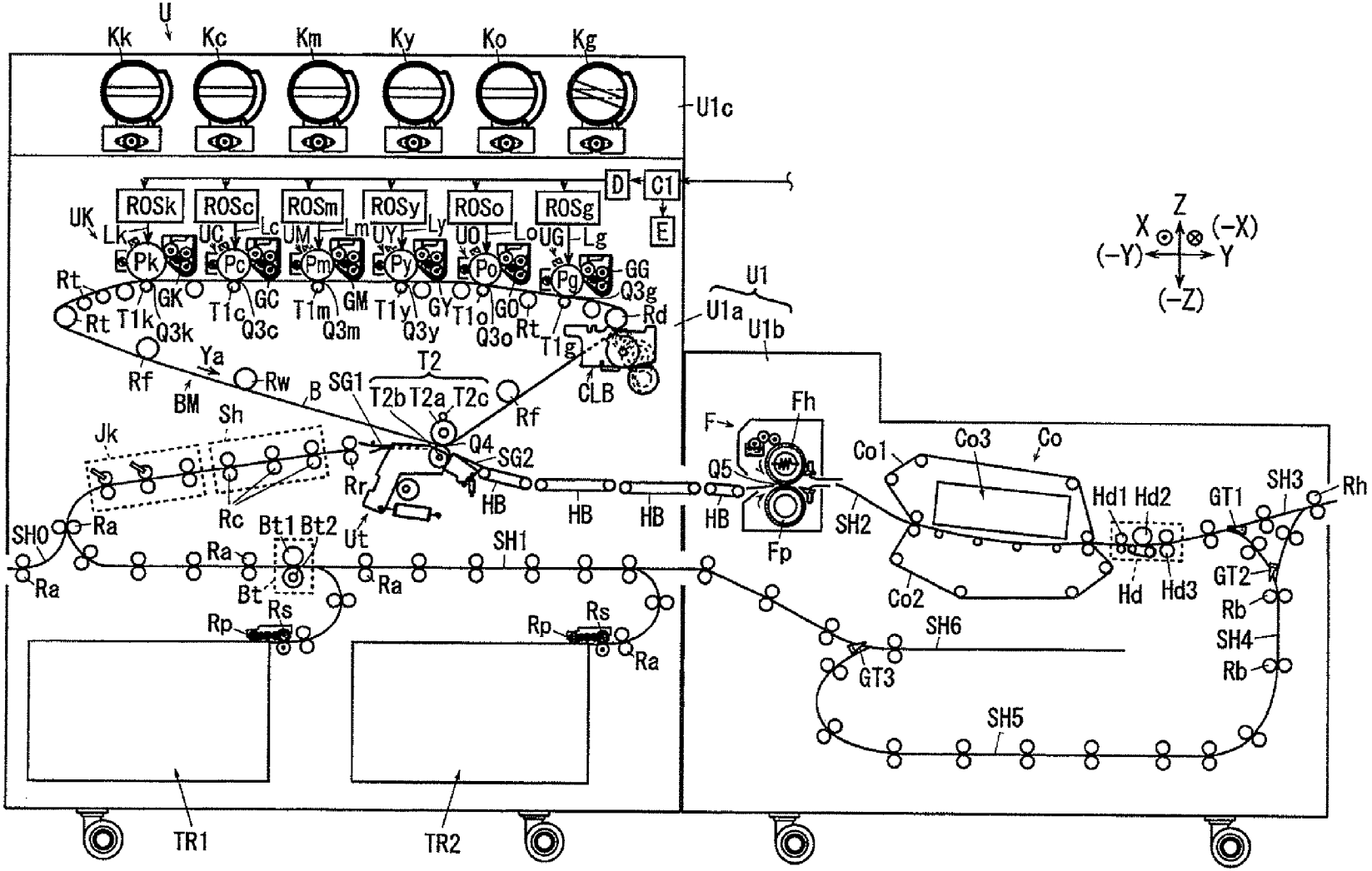
FIG. 2 is a schematic representation of an image forming apparatus main body of the printer of Exemplary Embodiment 1 of the invention.

FIG. 2 is a schematic representation of an image forming apparatus main body of the printer of Exemplary Embodiment 1 of the invention.

Figure 3:
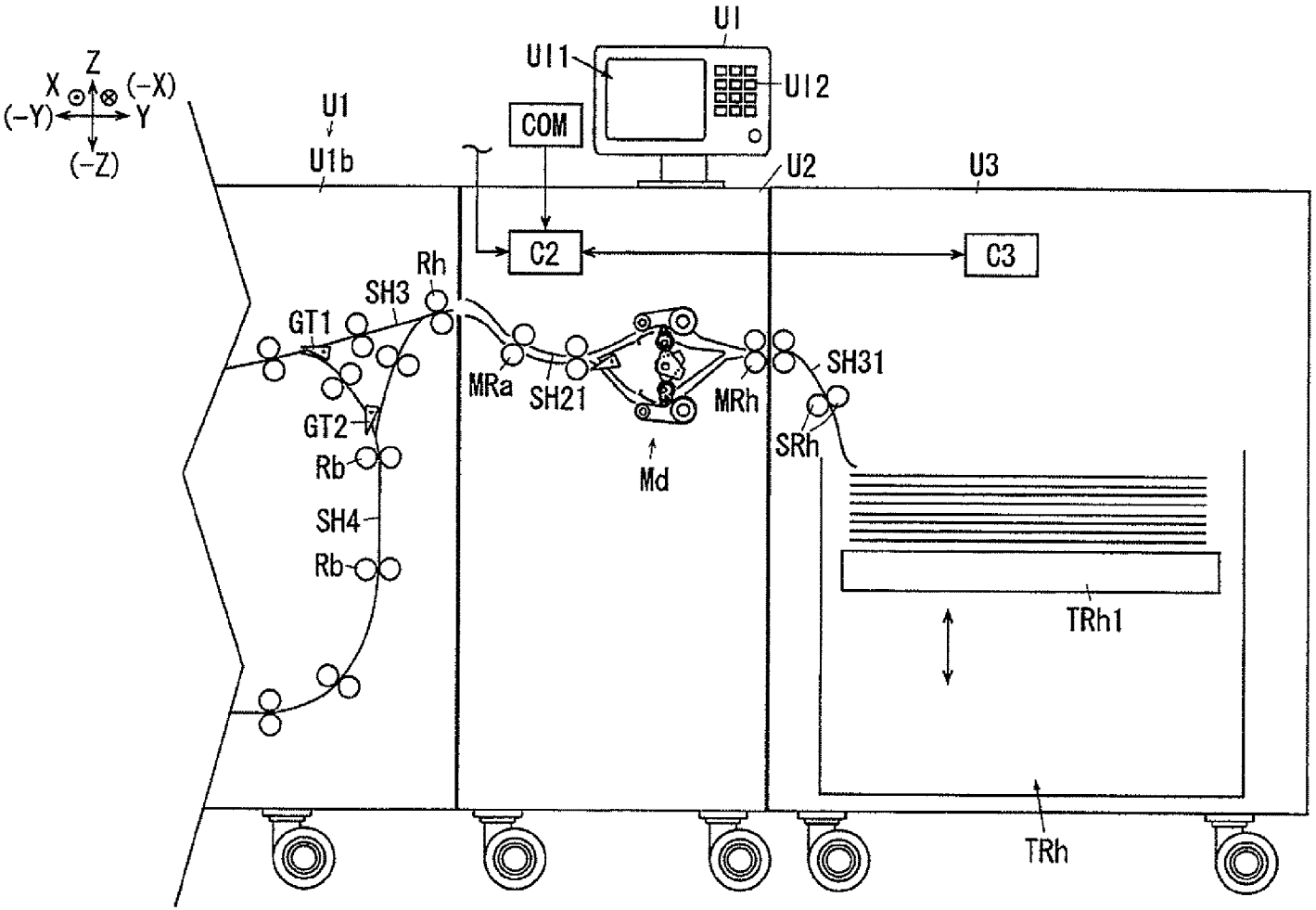
FIG. 3 is a schematic representation of an interface module and a stacker device of the printer of Exemplary Embodiment 1 of the invention.

FIG. 3 is a schematic representation of an interface module and a stacker device of the printer of Exemplary Embodiment 1 of the invention.

In FIGS. 1 to 3, a printer U as an example of an image forming apparatus has an image forming apparatus main body U1 as an example of an image record section, an interface module U2 placed downstream in a medium discharge direction of the image forming apparatus main body U1 and having an operation section UI for operating the printer U as an example of a bend removal section, and a stacker device U3 placed downstream in a medium discharge direction of the interface module U2 as an example of a medium discharge stack device.

Description of Image Forming Apparatus Main Body U1 of Exemplary Embodiment 1

In FIG. 2, the image forming apparatus main body U1 has an image record section U1*a*, a fix inversion section U1*b*, a main body side control section C1 for controlling the image forming apparatus main body U1, an information transmission and reception device (not shown) for receiving image information transmitted through the interface module U2 from an external information transmission device COM, and a latent image forming device drive circuit D, a power supply circuit E, etc., controlled by the main body side control section C1.

The latent image forming device drive circuit D of the image record section U1*a* controlled by the main body side control section C1 creates image information of G: Green, O: Orange, Y: Yellow, M: Magenta, C: Cyan, and K: Black based on image information transmitted through the interface module U2 and outputs drive signals responsive to the image information to latent image forming devices ROSg, ROSo, ROSy, ROSm, ROSc, and ROSk of the colors G to K at preset timings.

Figure 4:
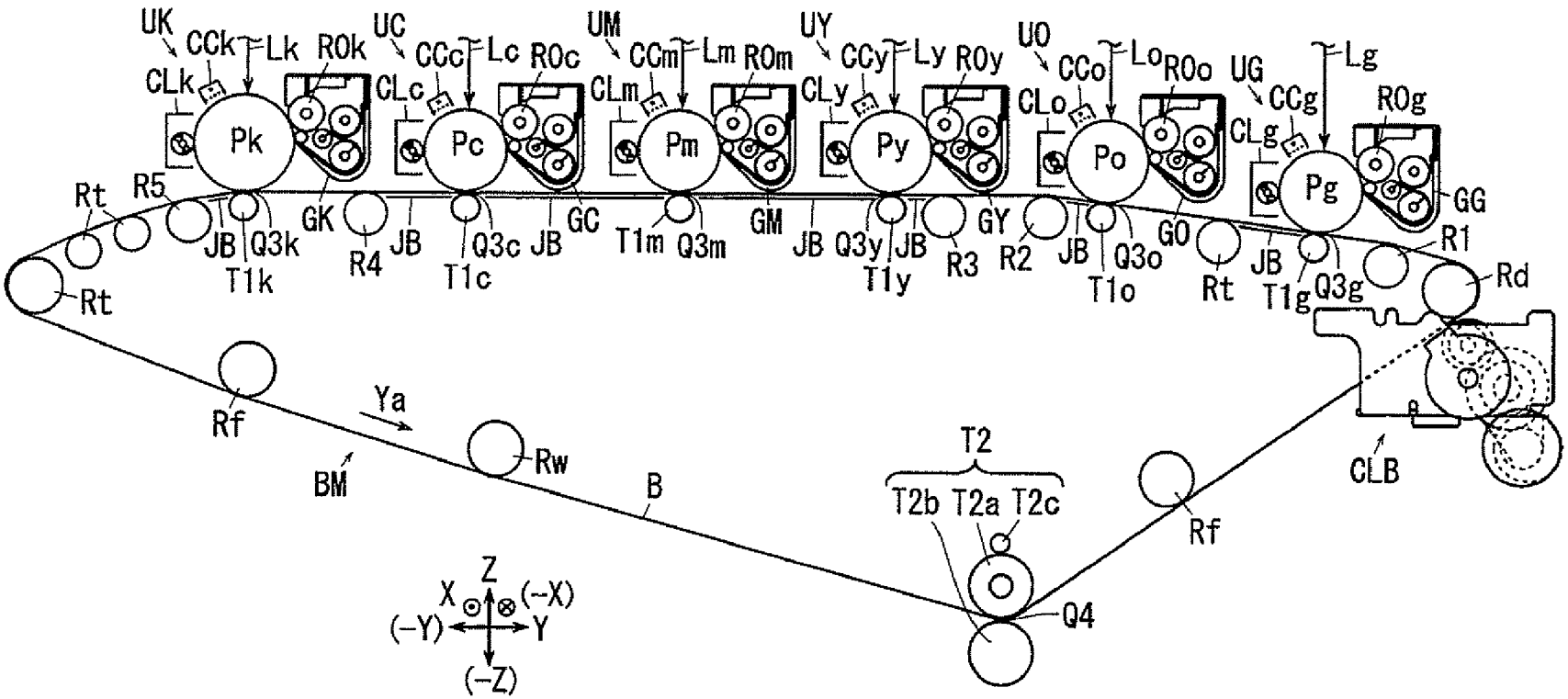
FIG. 4 is a main part enlarged schematic representation of the image forming apparatus main body and is a schematic representation of visible image forming devices and a belt module.

FIG. 4 is a main part enlarged schematic representation of the image forming apparatus main body and is a schematic representation of visible image forming devices and a belt module.

In FIGS. 2 and 4, image holding units UG, UO, UY, UM, UC, and UK of colors G to K and developing devices GG, GO, GY, GM, GC, and GK of colors G to K as an example of developing device are detachably placed below latent image forming devices ROSg to ROSk of colors G to K.

The image holding unit UK of black K has a photoconductive drum Pk as an example of an image holding body, a charger CCk, and a drum cleaner CLk as an example of an image holding body cleaner. A developing roll ROk as an example of a developing member of the developing device GK of black K is placed adjacent to the right of the photoconductive drum Pk.

The image holding units UG, UO, UY, UM, and UC of other colors G to C also have photoconductive drums Pg, Po, Py, Pm, and Pc, chargers CCg, CCo, CCy, CCm, and CCc, and drum cleaners CLg, CLo, CLy, CLm, and CLc respectively. Developing rolls ROg, ROo, ROy, ROm, and ROc as examples of developing members of the developing devices GG to GC of other colors G to C are placed adjacent to the right of the photoconductive drums Pg to Pc of other colors G to C respectively.

In Exemplary Embodiment 1, the photoconductive drum Pk of color K frequently used with much surface wear has a large diameter as compared with other color photoconductive drums Pg to Pc for high-speed rotation and a longer life.

The image holding units UG to UK and the developing devices GG to GK make up visible image forming devices (UG+GG), (UO+GO), (UY+GY), (UM+GM), (UC+GC), and (UK+GK).

In FIGS. 2 and 4, the photoconductive drums Pg to Pk are uniformly charged by the chargers CCg to CCk respectively and then electrostatic latent images are formed on surfaces by laser beams Lg, Lo, Ly, Lm, Lc, and Lk as an example of latent image write light output by the latent image forming devices ROSg to ROSk. The electrostatic latent images on the surfaces of the photoconductive drums Pg to Pk are developed to toner images as example of visible image of G: Green, O: Orange, Y: Yellow, M: Magenta, C: Cyan, and K: Black by developers in the developing devices GG to GK.

When the developers in the developing devices GG to GK are consumed by developing, the developing devices GG to GK are replenished with developers from a developer replenishing device U1*c* provided in an upper part of the image forming apparatus main body U1. Toner cartridges Kg, Ko, Ky, Km, Kc, and Kk each as an example of a developer replenishing vessel are detachably and replaceably supported in the developer replenishing device U1*c*.

In FIGS. 2 and 4, the toner images on the surfaces of the photoconductive drums Pg to Pk are transferred in an overlap manner in order onto an intermediate transfer belt B as an example of an intermediate transfer body by primary transfer rolls T1*g*, T1*o*, T1*y*, T1*m*, T1*c*, and T1*k* each as an example of a primary transfer member in primary transfer areas Q3*g*, Q3*o*, Q3*y*, Q3*m*, Q3*c*, and Q3*k* and a multiple color image, a so-called color image is formed on the intermediate transfer belt B. The color image formed on the intermediate transfer belt B is conveyed to a secondary transfer area Q4.

If black image data only exists, only the photoconductive drum Pk of black K and the developing device GK are used and only a toner image of black K is formed. If four-color print of Y, M, C, and K or two-color, three-color print, etc., responsive to setting of the user is executed, the corresponding photoconductive drums Pg to Pk and the corresponding developing devices GG to GK are used.

After the primary transfer, the remaining toner on the surfaces of the photoconductive drums Pg to Pk is cleaned by drum cleaners CLg to CLk for the photoconductive drums and the photoconductive drums are again charged by the chargers CCg to OCR.

In FIGS. 1, 2, and 4, a belt module BM as an example of an intermediate transfer device is supported so that it may move up and down between an up position coming in contact with the lower faces of the photoconductive drums Pg to Pk and a down position downward away from the lower faces below the photoconductive drums Pg to Pk.

The belt module BM has an intermediate transfer belt B. This intermediate transfer belt B is rotated in an arrow Ya direction by a belt drive roll Rd as an example of an intermediate transfer body drive member for supporting the intermediate transfer belt B from the back and is given tension by a tension roll Rt as an example of a tension giving member and is stretched. The back side of the intermediate transfer belt B is supported by a walking roll Rw as an example of a meander prevention member for preventing the intermediate transfer belt B from meandering, a plurality of idler rolls Rf each as an example of a driven member, and a backup roll T2*a* as an example of a secondary transfer opposed member.

In FIG. 4, in Exemplary Embodiment, a first retract roll R1 as an example of a contact/out of contact intermediate transfer body support member supported movably in a contact and out of contact direction, the direction perpendicular to the arrow Ya direction and the direction for bringing the intermediate transfer belt B into and out of contact with the photoconductive drum Pg is placed upstream in the arrow Ye direction of the primary transfer roll T1*g* of G color. A second retract roll R2 and a third retract roll R3 each as an example of the contact/out of contact intermediate transfer body support member configured like the first retract roll R1 are placed side by side downstream in the arrow Ye direction of each primary transfer roll T1*o* of O color and upstream in the arrow Ya direction of each primary transfer roll T1*y* of Y color. A fourth retract roll R4 as an example of the contact/out of contact intermediate transfer body support member configured like the first retract roll R1 is placed downstream in the arrow Ya direction of each primary transfer roll T1*c* of C color and upstream in the arrow Ye direction of each primary transfer roll T1*k* of K color. Further, a fifth retract roll R5 as an example of the contact/out of contact intermediate transfer body support member configured like the first retract roll R1 is placed downstream in the arrow Ye direction of each primary transfer roll T1*k* of K color. and upstream in the arrow Ye direction of each primary transfer roll T1*k* of K color.

In FIG. 4, a flat static elimination metal sheet JB as an example of a static elimination member for removing charge on the back of the intermediate transfer belt B is placed downstream in the arrow Ya direction of the primary transfer rolls T1*g* to T1*k*. The static elimination metal sheet JB of Exemplary Embodiment 1 is placed out of contact with the intermediate transfer belt B; for example, it may be placed at a 2-mm distance from the back of the intermediate transfer belt B.

The rolls Rd, Rt, Rw, Rf, T2*a*, and R1-R5 form belt support rolls Rd, Rt, Rw, Rf, T2*a*, and R1-R5 as an example of an intermediate transfer body support member for supporting the intermediate transfer belt B for rotation from the back.

The intermediate transfer belt B, the belt support rolls Rd, Rt, Rw, Rf, T2*a*, and R1-R5, the primary transfer rolls T1*g* to T1*k*, the static elimination metal sheet JB, and the like make up the belt module BM of Exemplary Embodiment 1.

A secondary transfer unit Ut is placed below the backup roll T2*a*. The secondary transfer unit Ut is provided with a secondary transfer roll T2*b* as an example of a secondary transfer member. The secondary transfer roll T2*b* is placed so that it may come in contact with and out of contact with the backup roll T2*a* across the intermediate transfer belt B. An area where the secondary transfer roll T2*b* is in press-contact with the intermediate transfer belt B forms a secondary transfer area Q4. A contract roll T2*c* as an example of a contact conduction member abuts the backup roll T2*a*. A secondary transfer voltage of the same polarity as the charge polarity of a developer is applied to the contract roll T2*c* at a preset timing from the power supply circuit E controlled by the main body side control section C1.

The backup roll T2*a*, the secondary transfer roll T2*b*, and the contract roll T2*c* make up a secondary transfer device T2 of Exemplary Embodiment 1. The primary transfer rolls T1*g* to T1*k*, the intermediate transfer belt B, and the secondary transfer device T2 make up transfer device T1*g* to T1*k*+T2+B of Exemplary Embodiment 1.

Sheet feed trays TR1 and TR2 each as an example of medium storage section in which a record sheet S as an example of a medium is stored are provided below the belt module BM. A record sheet S stored in the sheet feed tray TR1, TR2 is taken out from the sheet feed tray TR1, TR2 by a pickup roll Rp as a medium taking out member and is separated as one sheet at a time by a separation roll Rs as an example of a separation member and is conveyed to a medium supply passage SH1.

The record sheet S conveyed to the medium supply passage SH1 is conveyed to a deburr device Bt as an example of a medium unnecessary part removal device by a conveying roll Ra as an example of a medium conveying member. The deburr device Bt has a press roll Bt1 as an example of a press member and an opposed roll Bt2 pressed against the press roll Bt1 and coming in contact therewith as an example of an opposed member. The record sheet S is pressed, sandwiched, and conveyed by the press roll Bt1 and the opposed roll Bt2 and an unnecessary part of a record sheet S end part is removed, namely, the record sheet S is deburred.

The deburred record sheet S is conveyed to an overlap convey detector Jk. The overlap convey detector Jk detects whether or not record sheets cannot be separated as one sheet at a time by the separation roll Rs and more than one record sheet S is conveyed in an overlap manner (overlap covey).

A manual supply passage SH0 is connected upstream in the medium conveying direction of the overlap convey detector Jk and overlap convey of a record sheet S supplied from a manual medium supply section (not shown) is also detected by the overlap convey detector Jk.

The record sheet is conveyed from the overlap convey detector Jk to a skew correction device Sh which is an example of an inclined attitude correction device. The skew correction device Sh has a crossed roll Rc which is an example of a skew roll and brings the record sheet S into contact with an end part alignment member (not shown) for correcting inclined attitude of the record sheet S, so-called skew.

The record sheet S whose skew is corrected is conveyed to a registration roll Rr as an example of a conveying timing adjustment member.

The record sheet S conveyed to the registration roll Rr is conveyed through a before-transfer medium guide member SG1 to the secondary transfer area Q4 at the timing at which the multiple color image or single color image on the intermediate transfer belt B is conveyed to the secondary transfer area Q4.

When the multiple color image on the intermediate transfer belt B passes through the secondary transfer area Q4, the image is transferred to the record sheet S by the secondary transfer device. For the multiple color image, toner images primarily transferred to the surface of the intermediate transfer belt B in an overlap manner are secondarily transferred to the record sheet S collectively. The intermediate transfer belt B after the secondary transfer is cleaned by a belt cleaner CLB as an example of an intermediate transfer body cleaner.

In FIGS. 1 to 3, the record sheet S to which an unfixed visible image is secondarily transferred is conveyed through an after-transfer medium guide member SG2 to a fixing device F provided in the fix inversion section U1*b* by a conveying belt HB as an example of a before-fix medium conveying member.

In FIG. 3, the fixing device F has a heating roll Fh as an example of heat fixing member and a press roll Fp as an example of a press fix member. The record sheet S is conveyed to a fix area Q5 where a pair of fix members Fh and Fp comes in contact in a state in which pressure acts. The unfixed visible image on the record sheet S is heated and fixed by the fixing device F when it passes through the fix area Q5.

In FIG. 2, the heated and fixed record sheet S is conveyed to a cooling device Co. The cooling device Co has an upper conveying belt Co1 stretched for rotation as an example of an upper conveying member shaped like an endless belt and a lower conveying belt Co2 opposed to the upper conveying belt Co1 and stretched for rotation as an example of a lower conveying member shaped like an endless belt A heat sink Co3 as an example a radiation member is placed inside the upper conveying belt Co1 and heat of the upper conveying belt Co1 is taken away and is discharged to the outside by a wind sending member (not shown).

Accordingly, when the record sheet S heated by the fixing device F is sandwiched between the paired conveying belts Co1 and Co2 and is conveyed, heat of the record sheet S is taken away by the conveying belts Co1 and Co2 and the record sheet S is cooled.

The cooled record sheet S is conveyed to a main body decurl device Hd as an example of a bend removal device on the main body side. The main body decurl device Hd has a roll-type decurl member Hd1 for sandwiching the record sheet between an upper soft cylindrical member having a large diameter and a lower hard cylindrical member having a small diameter and removing bend of the record sheet, so-called curl as an example of a first bend removal member. A belt-type decurl member Hd2 for sandwiching the record sheet between a stretched endless belt member and a cylindrical member for coming in contact with the endless belt member from above and removing curl as an example of a second bend removal member is placed downstream in the medium conveying direction of the roll-type decurl member Hd1.

In the main body decurl device Hd, the curl of the record sheet is removed by the roll-type decurl member Hd1 and the belt-type decurl member Hd2 and then the record sheet is discharged from the main body decurl device Hd by a discharge member Hd3.

A conveying passage switch member GT1 is provided downstream in the medium conveying direction of the main body decurl device Hd. The conveying passage switch member GT1 selectively switches the conveying destination of the record sheet S conveyed through a main body processing passage SH2 as an example of a medium conveying passage to either a main body discharge passage SH3 or a medium inversion passage SH4.

The record sheet S conveyed to the main body discharge passage SH3 is conveyed to the interface module U2 with the image record face up, in so-called face up state by a main body discharge roll Rh as an example of a main body discharge member.

To convey the record sheet S to the interface module U2 with the image record face inverted to a down state from an up state, in so-called face down state, the record sheet S conveyed from the main body processing passage SH2 is guided to the medium inversion passage SH4 by the conveying passage switch member GT1. When the trailing end of the record sheet S in the medium conveying direction passes through a conveying passage switch member GT2 provided at the branch part of the medium inversion passage SH4, the record sheet S is inversely conveyed, namely, is switched back by an inversion roll Rb that may rotate forward and backward as an example of an inversion conveying member. The switch-backed record sheet S is guided to the main body discharge passage SH3 by the conveying passage switch member GT2 and the image record face of the record sheet S is inverted to the face down state from the face up state and the record sheet S is conveyed to the interface module U2.

To record an image on both sides of the record sheet S, the record sheet S with an image already recorded on one side conveyed from the main body processing passage SH2 is guided to the medium inversion passage SH4 by the conveying passage switch member GT1. The record sheet S is conveyed to a medium circulation passage SH5 by the inversion roll Rb in the medium inversion passage SH4 and is conveyed toward a double-side record inversion passage SH6. When the trailing end of the record sheet S in the medium conveying direction passes through a conveying passage switch member GT3 provided in a connection part of the medium circulation passage SH5 and the double-side record inversion passage SH6, the record sheet S is switched back. The switched-back record sheet S is guided to the medium supply passage SH1 side by the conveying passage switch member GT3 and is again sent to the medium supply passage SH1.

The record sheet S with an image recorded on one side is conveyed through the medium supply passage SH1 in a surface and back inversion state and is again sent to the secondary transfer area Q4 and an image is recorded on the other side where no image is recorded.

Description of Interface Module U2 of Exemplary Embodiment 1

In FIG. 3, the operation section UI of the interface module U2 has a display section UI1 for displaying information and input buttons UI2 for making various settings of the printer U. The interface module U2 has a main control section C2 for receiving image information from the external information transmission device COM and controlling various types of processing and the printer U.

A curl removal passage SH21 as an example of a conveying passage of a bend removing device is provided in the interface module U2. The record sheet S is conveyed to the curl removal passage SH21 from the main body discharge passage SH3 of the image forming apparatus main body U1. The record sheet S conveyed to the curl removal passage SH21 is conveyed to a module decurl device Md as an example of a bend removing device main body by a conveying roll MRa. Curl of the record sheet S is removed by the module decurl device Md and the record sheet S is discharged from the curl removal passage SH21 to the stacker device U3 by a discharge roll MRh. The module decurl device Md is already known and may adopt a similar configuration to that described in Japanese Patent Laid Open. No. 2006-520333 and therefore will not be discussed again in detail.

Description of Stacker Device U3 of Exemplary Embodiment 1

In FIG. 3, the stacker device U3 of Exemplary Embodiment 1 has a stacker discharge passage SH31 connected to the curl removal passage SH21 of the interface module U2 as an example of a conveying passage of the medium discharge stack device. A stacker discharge roll SRh as an example of a medium discharge number of the medium discharge stack device is placed downstream in the medium conveying direction of the stacker discharge passage SH31. The record sheet S is discharged to and is stacked in a stacker vessel TRh as an example of a stack example placed in a lower part by the stacker discharge roll SRh. A bottom plate TRh1 on which the record sheet is stacked as an example of a stack member is placed in the stacker vessel TRh. The bottom plate TRh1 is automatically moved up and down in response to the stack amount of the record sheets S.

Description of Medium Conveying Device

Figure 5B:
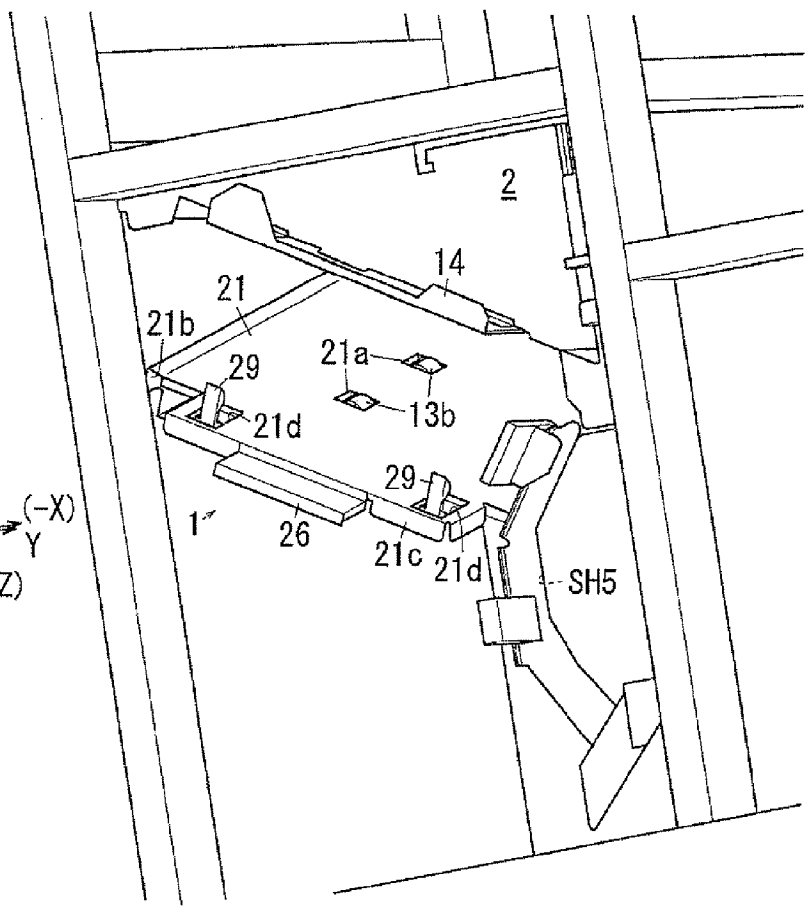
FIGS. 5A and 5B is schematic representations of viewing a relay conveying unit of Exemplary Embodiment 1 from right slanting above.
Figure 5A:
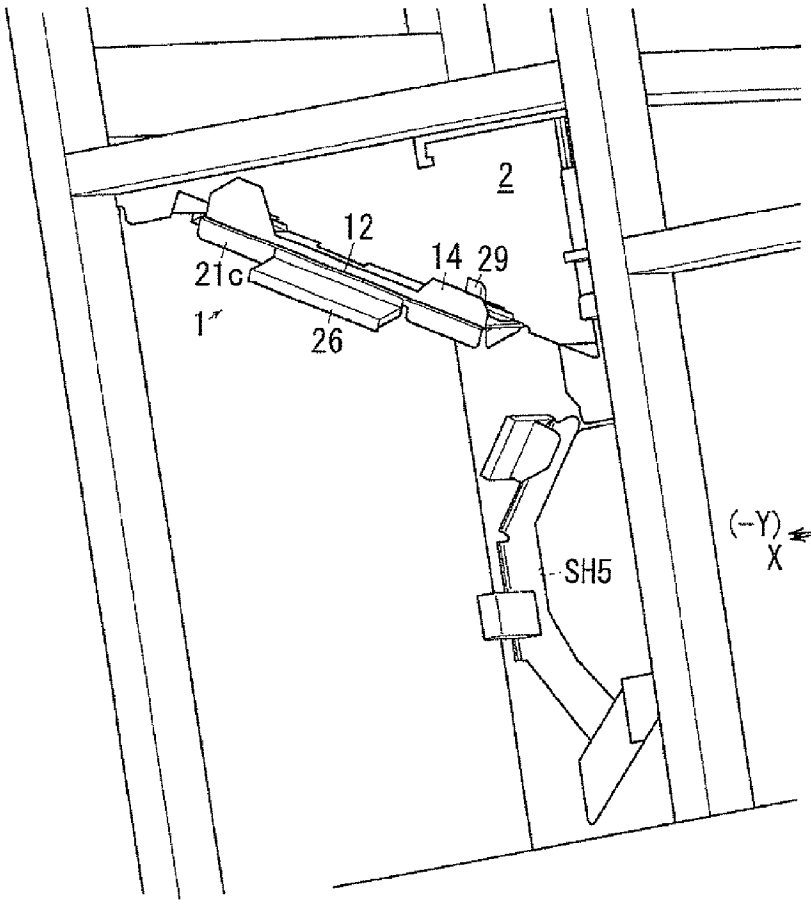

FIGS. 5A and 5B are schematic representations of viewing a relay conveying unit of Exemplary Embodiment 1 from right slanting above; FIG. 5A is a schematic representation of a state in which the relay conveying unit is moved to a closed position and FIG. 5B is a schematic representation of a state in which the relay conveying unit is moved to an open position.

Figure 6A:
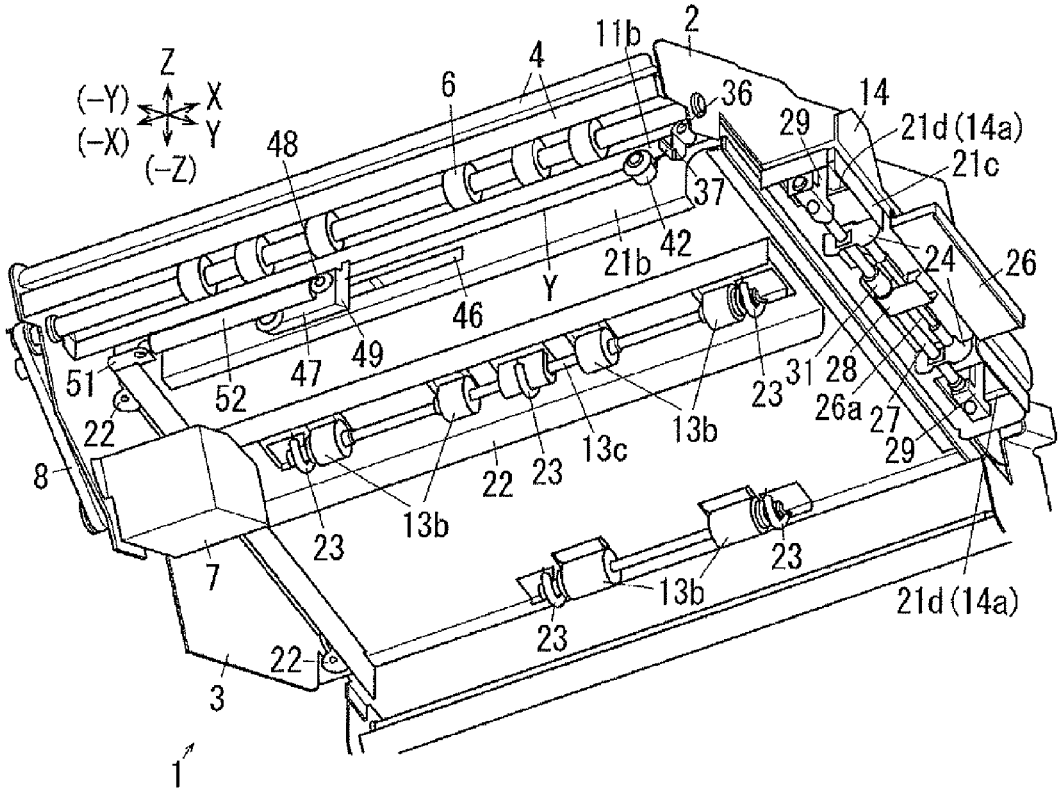
FIGS. 6A and 6B are schematic representations of viewing the relay conveying unit of Exemplary Embodiment 1 from left slanting below.
Figure 6B:
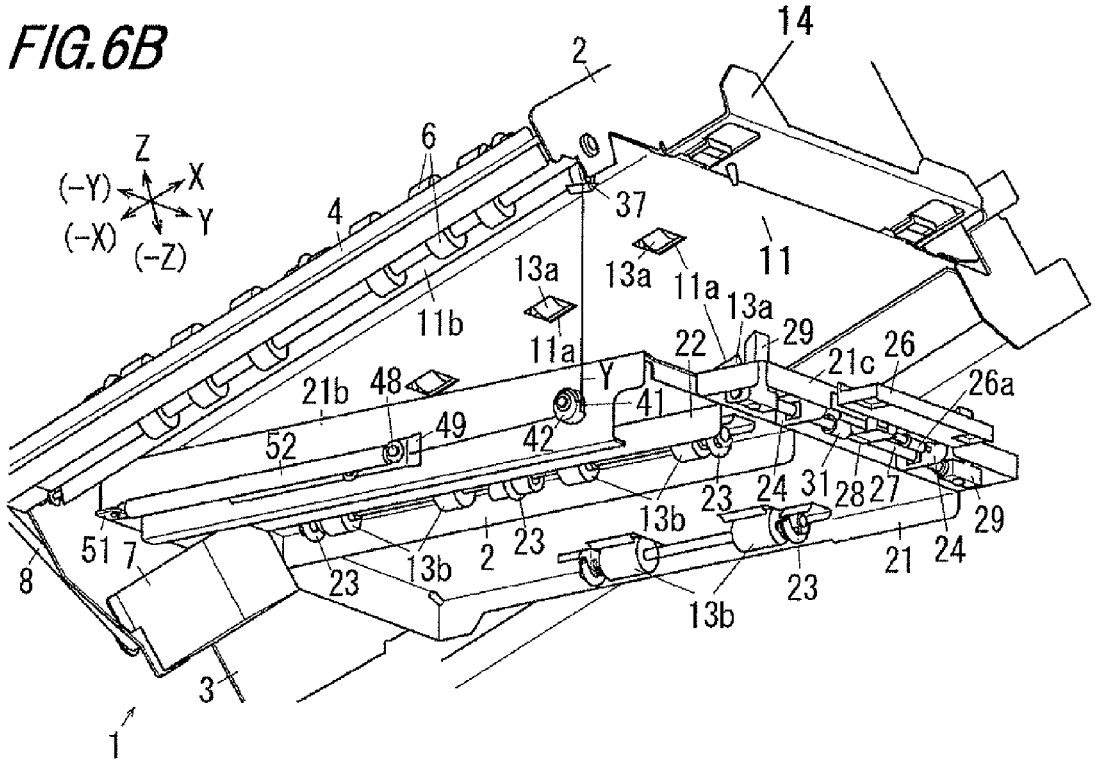

FIGS. 6A and 6B are schematic representations of viewing the relay conveying unit of Exemplary Embodiment 1 from left slanting below; FIG. 6A is a schematic representation of a state in which the relay conveying unit is moved to a closed position and FIG. 6B is a schematic representation of a state in which the relay conveying unit is moved to an open position.

In FIGS. 1, 5A, 5B, 6A and 6B, a relay conveying unit 1 as an example of a medium conveying device has a pair of front and back frames 2 and 3. A unit discharge guide 4 extending in the front and back direction as an example of a discharge guide section is supported at the left end of each of the frames 2 and 3. A pair of up and down unit discharge rollers 6 for discharging the record sheet S from the relay conveying unit 1 through the unit discharge guide 4 as an example of a medium conveying member is supported on the right of the unit discharge guide 4. In FIG. 6, a motor unit 7 as an example of a drive source is supported on the back frame 3 and drive is transmitted from the motor unit 7 to the unit discharge rollers 6 through a transmission belt 8 as an example of a drive transmission member.

In FIG. 6B, an upper guide plate 11 as an example of a first guide member is supported on the right of the unit discharge rollers 6. A lower face of the upper guide plate 11 is opposed to an upper face as an example of one face of the conveyed record sheet S and guides the upper face of the record sheet S. In FIG. 6B, the upper guide plate 11 is formed with a plurality of openings 11*a* so that a drive roller 13*a* of a relay conveying roller 13 as an example of a medium conveying member placed in a relay conveying passage 12 as an example of a conveying passage enters the relay conveying passage 12. An upper bend part 11*b* bent upward is formed at the left end of the upper guide plate 11.

In FIGS. 5A to 6B, a closing hold plate 14 extending forward from the front end of the upper guide plate 11 as an example of a closing holding section is supported on the front of the front frame 2, namely, the front side in a direction in which the record sheet S is removed when a paper jam in the relay conveying passage 12 occurs. In FIG. 6A, the closing hold plate 14 is formed with a pair of left and right latch engagement ports 14*a* piercing in the up and down direction as an example of a hold engagement part.

In FIGS. 5A to 6B, a lower guide plate 21 formed like opposed plate and forming the relay conveying passage 12 in a space between the upper guide plate 11 and the lower guide plate 21 as an example of a second guide member is placed below the upper guide plate 11. The lower guide plate 21 is opposed to a lower face as an example of an opposite face of the conveyed record sheet S and guides the lower face of the conveyed record sheet S. In FIG. 6A, the lower guide plate 21 is rotatably supported with a pair of left and right rotation support parts 22 provided in the rear frame 3 as the rotation center. Therefore, the lower guide plate 21 may move between the closed position shown in FIGS. 5A and 6A where the upper face of the lower guide plate 21 is opposed to the lower face of the upper guide plate 11 to form the relay conveying passage 12 and the open position shown in FIGS. 5B and 6B where the upper face of the lower guide plate 21 rotates downward and the relay conveying passage 12 is opened.

In FIG. 5B, the lower guide plate 21 is formed with an opening 21*a* corresponding to the opening 11*a* of the upper guide plate 11. In FIG. 6, at the left end of the lower guide plate 21, a lower bend part 21*b* bent downward is formed corresponding to the upper bend part 11*b*. In FIGS. 5 and 6, a handle support part 21*c* hanging over forward as an example of an operation support part is formed at the front end of the lower guide plate 21. The handle support part 21*c* is formed with latch passage ports 21*d* each as an example of a hold passage part at the positions corresponding to the latch engagement ports 14*a*.

In FIGS. 6A and 6B, a driven roller 13*b* of the relay conveying roller 13 corresponding to the opening 21*a* shown in FIG. 5A is rotatably supported on the lower face of the lower guide plate 21 through a roller support 22 as an example of a driven support member. In Exemplary Embodiment 1, the driven roller 13*b* is supported so that a coil spring 23 as an example of an urging member is wound around a bearing part of a rotation axis 13*c*. The coil spring 23 urges the driven roller 13*b* to the drive roller 13*a* side so that the driven roller 13*b* comes in contact with the drive roller 13*a* at a preset contact pressure. A rubber may be used instead of the spring.

In FIGS. 6A and 6B, a pair of front and back support plates 24 extending downward is formed on the lower face of the handle support part 21*c*. A handle 26 as an example of an operation part is supported rotatably with a rotation center 26*a* as the center on the front of the support plates 24. A rotation shaft 27 extending in the left-right direction along the lower guide plate 21 as an example of rotation center is rotatably supported on the back of the support plates 24. A handle association member 28 that extends forward and may come in contact with the lower face of the handle 26 as an example of an operation association member is supported in the center in the left-right direction of the rotation shaft 27.

Each latch 29 as an example of a held member is supported at the positions corresponding to the latch passage ports 21*d* at both left and right ends of the rotation shaft 27. The latches 29 pass through the latch passage ports 21*d* and extend upward. In a state in which the lower guide plate 21 moves to the closed positions, the latches 29 pass through the latch engagement ports 14*a* of the upper guide plate 11 and a claw part formed on the upper back face may engage a margin of each latch engagement port 14*a*.

A closing spring 31 as an example of a rotation giving member for giving a force for rotating the rotation shaft 27 in a direction in which the upper end of the latch 29 rotates backward is attached to the rotation shaft 27 on the left of the handle association member 28.

Therefore, when the operator operates the handle 26 and rotates the front end of the handle 26 downward, the handle association member 28 is pushed downward and rotates and the rotation shaft 27 rotates against the elastic force of the closing spring 31. Thus, the latch 29 also rotates with rotation of the rotation shaft 27 and engagement of the latch 29 and the latch engagement port 14*a* is released and the lower guide plate 21 becomes a state in which it may rotate toward the open position. When the operator releases the handle 26, the elastic force of the closing spring 31 acts and the latch is held in a state in which it is engaged in the latch engagement port 14*a*.

Description of Open Hold Device

Figure 7A:
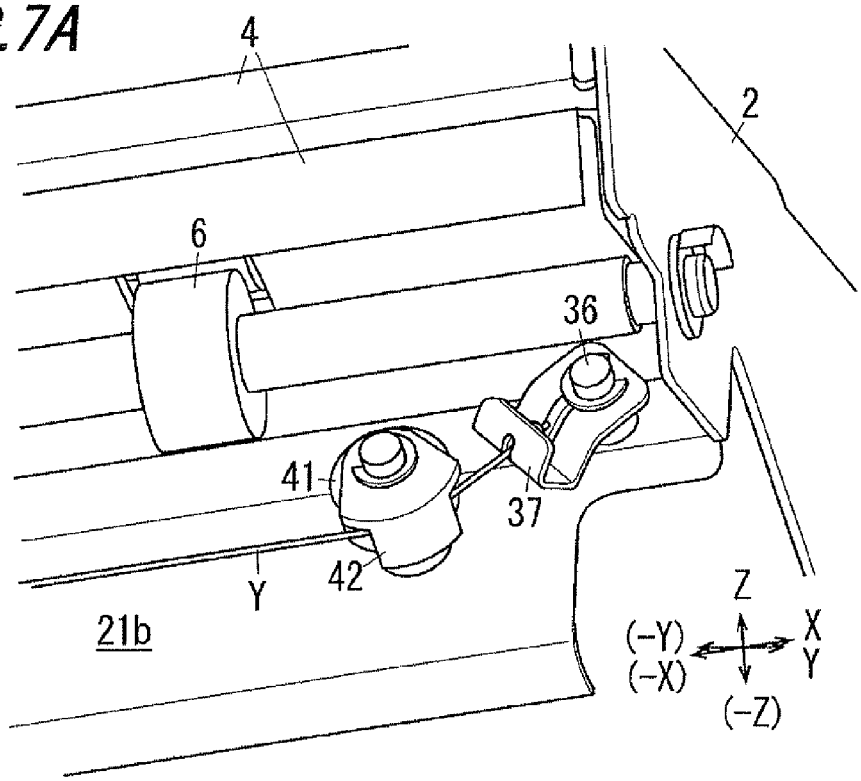
FIGS. 7A and 7B are main part schematic representations of an open/closed hold device of Exemplary Embodiment 1.
Figure 7B:
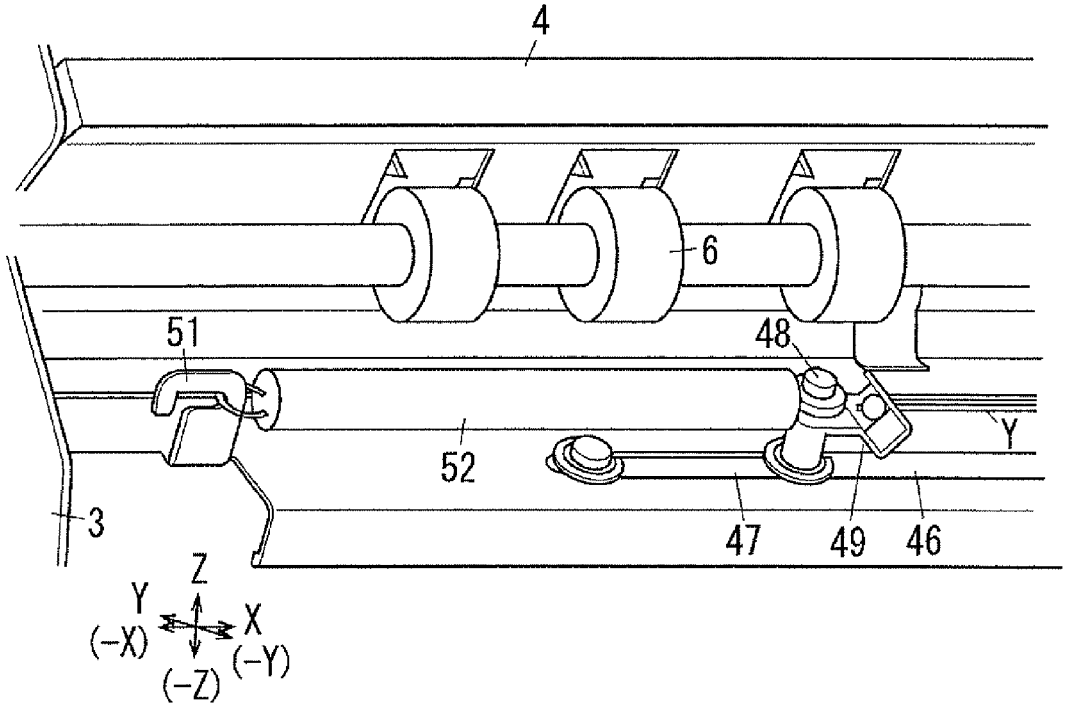

FIG. 7 is a main part schematic representation of an open/closed hold device of Exemplary Embodiment 1; FIG. 7A is a main part schematic representation of a one end support member and FIG. 7B is a main part schematic representation of an opposite end support member.

Figure 8A:
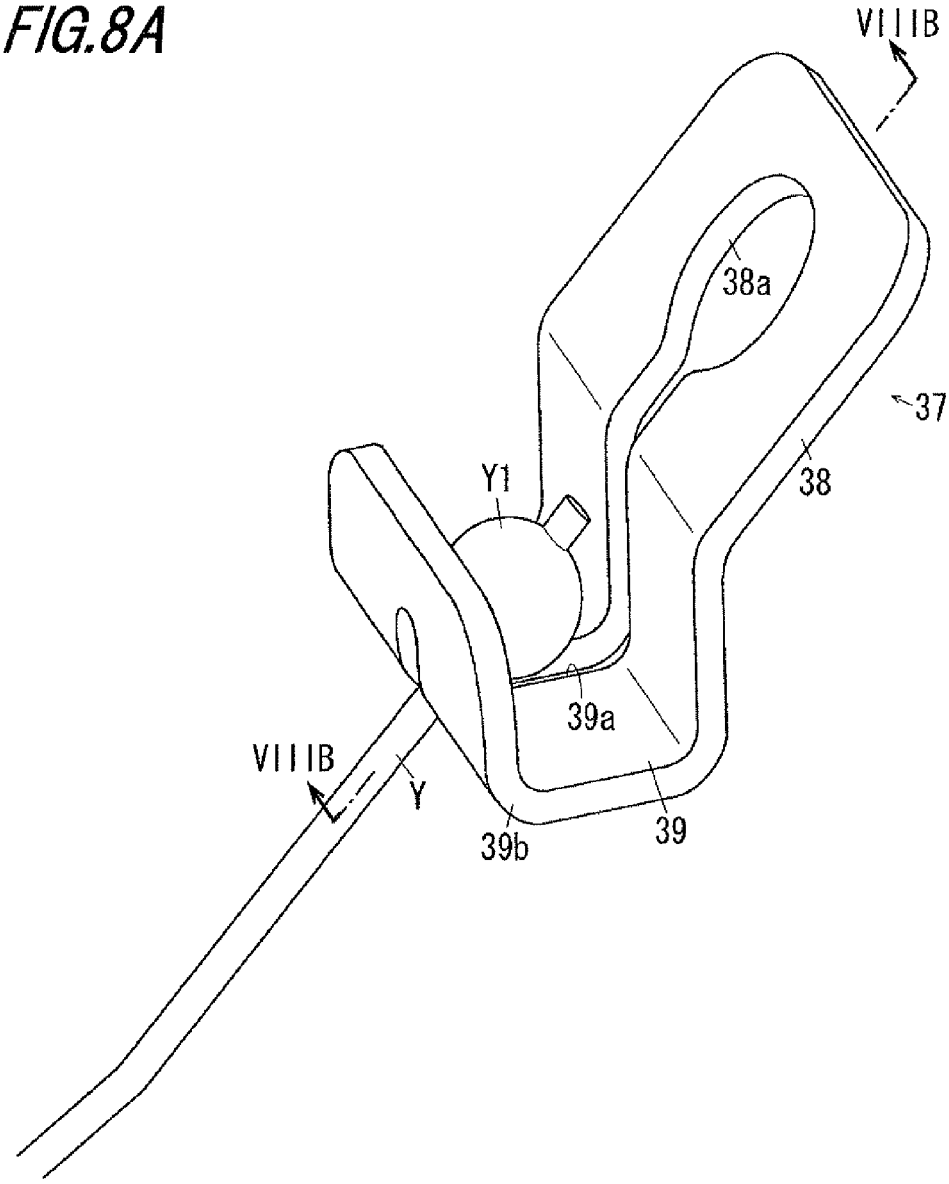
FIGS. 8A and 8B are schematic representations of the one end support member of Exemplary Embodiment 1.

FIG. 8 is a schematic representation of the one end support member of Exemplary Embodiment 1; FIG. 8A is a perspective view and FIG. 88 is a sectional view taken on line VIIIB-VIIIB in FIG. 8A.

In FIGS. 6 and 7, a pin 36 as an example of rotation center projecting to the left is supported at the front end of the upper bend part 11*b* of the upper guide plate 11. A wire hold bracket 37 as an example of a one end part support member for supporting one end of a wire Y as an example of a string-like member and an example of an open hold member is supported on the pin 36.

In FIGS. 7A and 8A, the wire hold bracket 37 of Exemplary Embodiment 1 has a flat-plate-like rotated support part 38 as an example of a one end rotation part and a wire support part 39 as an example of a one end support main body of a shape with a flat plate bent shaped like angular U on a side view from the tip of the rotated support part 38.

The rotated support part 38 is formed with a large diameter hole 38*a* that the pin 36 may pierce. The wire support part 39 is formed with a slit-like wire passage slit 39*a* extending from the large diameter hole 38*a* and having a narrower width than the diameter of the large diameter hole 38*a* and having a wider width than the outer diameter of the wire Y.

Figure 8B:
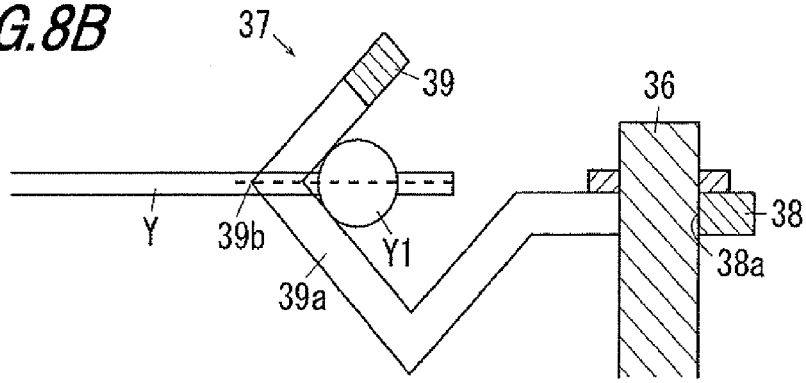

In FIG. 8B, in Exemplary Embodiment 1, the wire Y is formed at one end with a spherical part Y1 having a larger diameter than the wire passage slit 39*a* and having a smaller diameter than the large diameter hole 38*a* as an example of a one end supported part. The spherical part Y1 is held in a state in which it is in contact with a support angular part 39*b* of the wire support part 39 as an example of a one end support part. At this time, in Exemplary Embodiment 1, the position of the support angular part 39*b* is placed so as to become on an extension of the rotated support part 38 and the wire Y extends onto an extension of a line connecting the rotated support part 38 and the support angular part 39*b*.

In FIGS. 6 and 7A, a guide roller 41 for backward guiding the wire Y from the upper wire hold bracket 37 as an example of a string guide part is rotatably supported in the front end part of the lower guide plate 21. A cover guide 42 for sandwiching the wire Y between the guide roller 41 and the cover guide and preventing dropping off while guiding the wire Y as an example of a dropping-off prevention member is supported in the guide roller 41.

Figure 9:
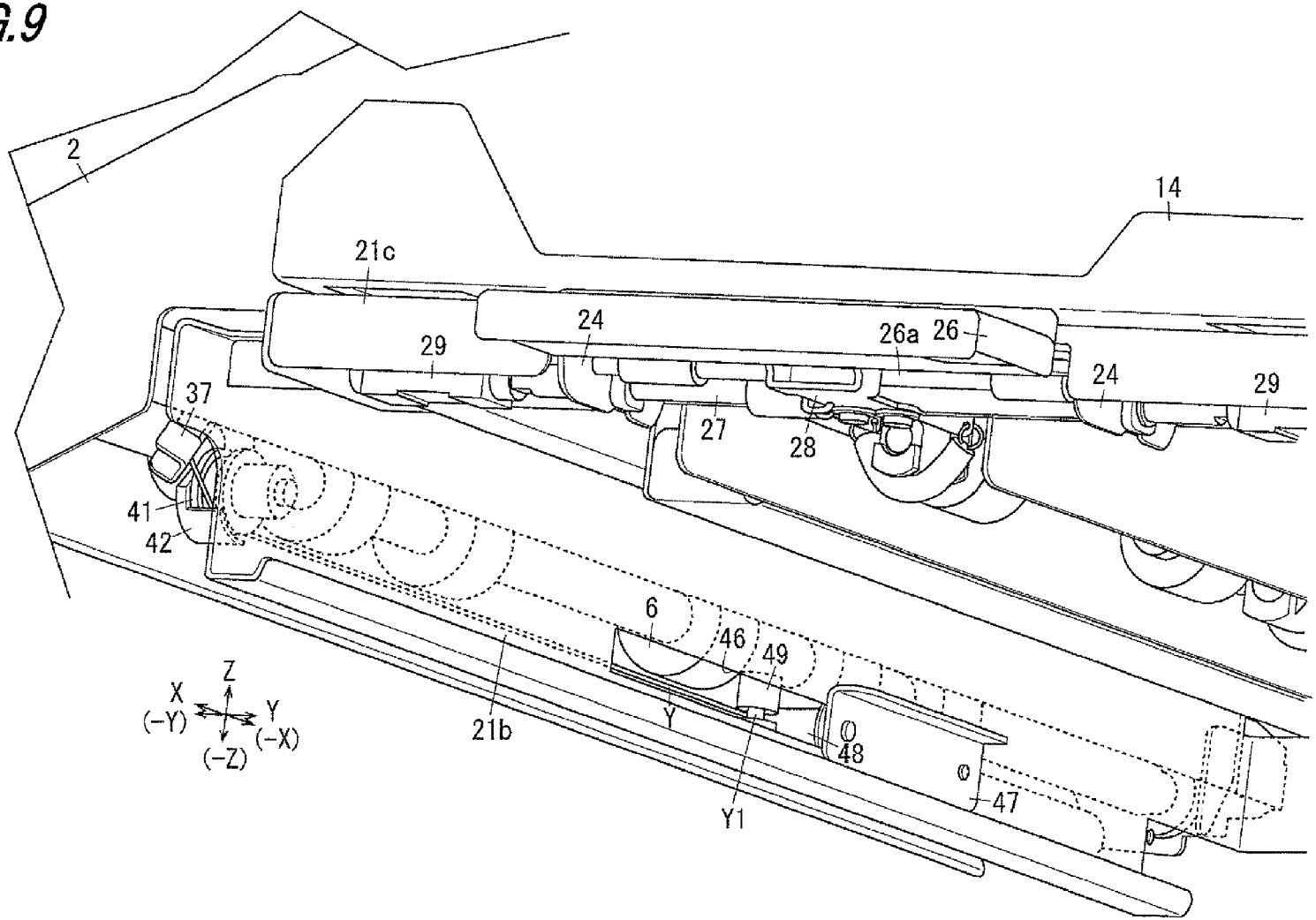
FIG. 9 is a main part enlarged drawing of a slider portion of the open/closed hold device of Exemplary Embodiment 1.

FIG. 9 is a main part enlarged drawing of a slider portion of the open/closed hold device of Exemplary Embodiment 1.

In FIGS. 6, 7B, and 9, the lower guide plate 21 is formed in the rear end part with an opening-like slider guide 46 extending in the front and back direction as an example of a move guide part. A slider 47 as an example of a moving body is supported on the slide guide 46 so that it may move in the front and back direction along the slide guide 46. The slider 47 moves between a closed move position shown in FIG. 6A and an open move position shown in FIG. 6B.

The slider 47 has a pin 48 as an example of a rotation shaft projecting to the left from the front end part of the slider 47. A wire hold bracket 49 configured like the wire hold bracket 37 as an example of an opposite end support member is rotatably supported on the pin 48. Therefore, the wire hold bracket 49 has a flat-plate-like rotated support part as an example of an opposite end rotation part and a wire support part as an example of an opposite end support main body. The opposite end of the wire Y, like the one end, is supported by the spherical part Y1 and the wire hold bracket 49.

In FIGS. 6 and 7B, the lower guide plate 21 is formed in the rear end part with a spring joint part 51 as an example of an urging support part, and a coil spring 52 as an example of an urging member is joined between the spring joint part 51 and the pin 48 of the slider 47. The coil spring 52 urges the slider 47 toward the closed move position shown in FIG. 6A.

The wire hold brackets 37 and 49, the roller 41, the cover guide 42, the slider 47, the spring 52, the wire Y, and the like make up the open hold device 37 to 52+Y of Exemplary Embodiment 1.

Operation of Exemplary Embodiment 1

In the image forming unit U of Exemplary Embodiment 1 having the configuration described above, if a jam of the record sheet occurs, the handle 26 placed on the front of the relay conveying unit 1 where jam removal is performed is operated and engagement of the latch 29 and the latch engagement port 14*a* is released. When the latch 29 is released, the lower guide plate 21 becomes a state in which it may be opened and closed and the lower guide plate 21 moves the open position shown in FIGS. 5B and 6B with the tare weight of the lower guide plate 21 and operation of the operator. At this time, as the lower guide plate 21 moves from the closed position to the open position, the spacing between the open hold device 37 of the upper guide plate 11 and the guide roller 41 widens and the slider 47 where the opposite end of the wire Y is supported moves forward against the elastic force of the coil spring 52. That is, in Exemplary Embodiment 1, the coil spring 52 has a function of a damping member, a damper; injury of the operator or the like as the lower guide plate 21 moves to the open position at high speed is decreased as compared with case where the coil spring 52 is not provided.

When the lower guide plate 21 moves to the open position, the front of the relay conveying passage 12 is opened as shown in FIGS. 5B and 6B, enabling the operator to remove the record sheet S jammed in the relay conveying passage 12. At this time, in Exemplary Embodiment 1, the wire Y astride the upper guide plate 11 and the lower guide plate 21 is placed in the left part of each guide plate 11, 21 and the wire Y astride up and down is not placed on the front where the record sheet S is removed.

If the wire Y is placed astride the front where the record sheet S is removed as former, the wire Y closes a part of the front and hinders removal of the record sheet S. Particularly, if a sheet long in the sheet conveying direction is used, the operator needs to bend, round, buckle, etc., the long sheet to such an extent that the wire Y is avoided, and workability very worsens. In the configuration wherein the wire Y holds the lower guide plate 21 in a dangling state, the wire Y needs to hold a measure of strength and tension acts and if the operator touches the wire during working, it is feared that the operator may be injured. Particularly, if the strength when dangling as a wide belt-like shape rather than a wire is enhanced, the fear of injury of the operator touching it increases.

In contrast, in the configuration of Exemplary Embodiment 1, the wire Y astride up and down is placed on a side and is not placed the front where the record sheet S is removed; the workability of removing the record sheet S improves and unexpected injury of the operator is decreased as compared with the conventional configuration.

Figure 10:
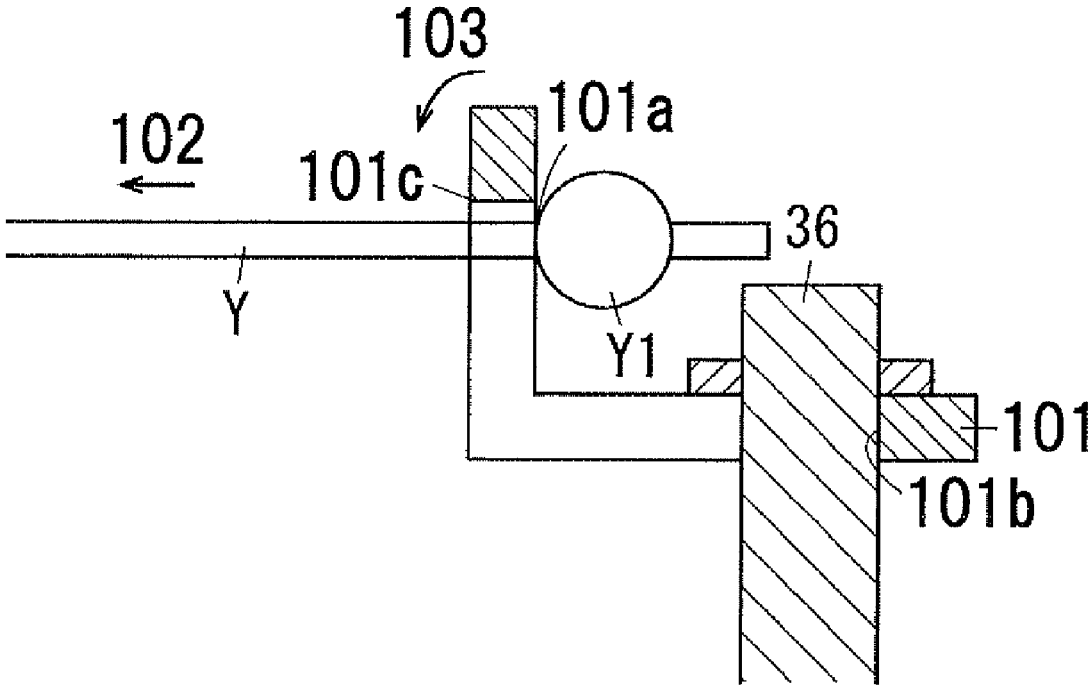
FIG. 10 is a schematic representation of another form of wire hold bracket.

FIG. 10 is a schematic representation of another form of wire hold bracket.

In FIG. 10, a wire hold bracket 101 shaped like letter L may also be used in place of the wire hold bracket 37, 49. However, to use the wire hold bracket 101 shaped like letter L, if the lower guide plate 21 moves to the open position, etc., and tension acts on the wire Y, a contact position 101*a* between the spherical part Y1 of the wire and the wire hold bracket 101 is a shift position relative to a direction 102 in which the tension of the wire Y acts relative to a position 101*b* supported rotatably on the pin 36, and the force in a direction 103 rotating the wire hold bracket 101 easily acts. If the force of the rotating direction 103 acts, the positional relationship between the pin 36 and the wire hold bracket 101 changes and it is feared that rotation of the wire hold bracket 101 may worsen. If the force of the rotating direction 103 acts, it is feared that a corner 101*c* of a wire passage slit of the wire hold bracket 101 and the wire Y may come in contact with each other and it is also feared that the wire may be cut as the corner 101*c* and the wire Y comes in contact with each other.

In contrast, in Exemplary Embodiment 1, the wire Y extends onto the extension of the line connecting the rotated support part 38 and the support angular part 39*b*, the force of the rotating direction 103 scarcely acts, and worsening of rotation of the wire hold bracket 37, 49 and fear of cutting of the wire Y are decreased.

Modified Examples

While the exemplary embodiment of the invention has been described in detail, it is to be understood that the invention is not limited to the specific exemplary embodiment described above and various changes and modifications may be made without departing from the spirit and the scope of the invention as claimed. Modified examples (H01) to (H08) of the invention are illustrated below:

(H01) In the exemplary embodiment described above, the printer U is illustrated as an example of the image forming apparatus, but the image forming apparatus is not limited to the printer; for example, it may be implemented as a copier, FAX, or a multiple function device including all or some of the functions, etc.

(H02) In the exemplary embodiment described above, the configuration in which developers of six colors are used is illustrated as the printer U, the print U is not limited to it; for example, the printer U may be applied to a single-color image forming apparatus and a multicolor image forming apparatus of five colors or less or seven colors or more.

(H03) In the exemplary embodiment described above, the configuration having the slider 47 is desirable, but the configuration is not limited to it. For example, the Y expands and contracts and the slider 47 may be omitted or a reel-like configuration wherein the wire is wound and delivered may also be adopted.

(H04) In the exemplary embodiment described above, the coil spring 52 is illustrated as the configuration for damping, but the configuration is not limited to it. Any desired damper mechanism, cushion mechanism, torque limiter, etc., may also be adopted. It is desirable that the configuration for damping should be provided, but the configuration may also be omitted.

(H05) In the exemplary embodiment described above, the configuration of the wire hold bracket 37, 49 is not limited to the illustrated configuration and any desired configuration capable of holding the wire Y may be adopted.

(H06) In the exemplary embodiment described above, the wire Y is illustrated as an example of a string-like member, but it is not limited to the wire Y. A wide string-like member, for example, a band or belt-like member may also be adopted.

(H07) In the exemplary embodiment described above, the latch 29 for holding the closed state is illustrated, but it is not limited to the latch 29 and any desired configuration capable of holding the closed state may be adopted.

(H08) In the exemplary embodiment described above, the configuration wherein the upper guide plate 11 is fixed and the lower guide plate 21 rotates is illustrated, but the configuration is not limited to it. A configuration wherein the upper guide plate 11 rotates or both guide plates 11 and 21 rotate may also be adopted. That is, a second guide member of at least one guide member may be able to move and it is possible to adopt a configuration wherein both guide members may move. The configuration is not limited to the rotating configuration and it is also possible to adopt a configuration wherein the guide plates 11 and 21 slide in a direction in which they are brought close to or away from each other while keeping a parallel relationship between the guide plates 11 and 21.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

DESCRIPTION OF REFERENCE NUMERALS

1: Medium conveying device
11: First guide member
12: Conveying passage
13: Conveying member
14: Closed hold member
21: Second guide member
29: Held member
37: One end part support member
37 to 52+Y: Open hold device
38: One end rotation part
39: One end support part
46: Move guide part
47: Moving body
48: Rotation shaft
49: Opposite end support member
52: Urging member
S: Medium
U: Image forming apparatus
U1*a*: Image record section.
Y: Open hold member, string-like member

What is claimed is:

1. A medium conveying device comprising:

a first guide member that guides one face of a medium to be conveyed and opposed to the one face when the medium is conveyed;

a second guide member that guides the other face of the medium and is opposed to the other face when the medium is conveyed, the second guide member being movable between a close position and an open position;

a conveying member that is provided in a conveying passage formed by the first guide member and the second guide member being at the close position in order to convey the medium in the conveying passage; and a support member that keeps the second guide member at the open position and is provided at an edge of the second guide member that extends in a direction transverse to the direction in which the medium is conveyed such that the medium crosses the edge when conveyed by the conveying member, wherein when the second guide member is at the open position, the medium in the conveying passage is removable from the conveying passage.

2. The medium conveying device according to claim 1, wherein the second guide member is rotatably supported with a rotation center placed on one end of the second guide member so that the medium in the conveying passage is removable from the conveying passage through another end of the second guide member, the support member includes a moving portion that is provided on the second guide member and that is movable in a given direction relative to the second guide member according to a movement of the second guide member and a string member one end of which is connected to the moving portion and the other end of which is connected to the first guide member.

3. The medium conveying device according to claim 2, wherein the moving portion moves in a first direction relative to the second guide member when the second guide member moves in a third direction from the open position to the close position, the moving portion moves in a second direction opposite to the first direction when the second guide member moves in a fourth direction opposite to the third direction, and the support member includes an urging member that urges the moving portion toward the first direction.

4. The medium conveying device according to claim 3, wherein the second guide member is not moved when the moving portion is not moved.

5. The medium conveying device according to claim 2 further comprising:

a one end rotation part that is rotatably supported relative to a rotation shaft provided on the first guide member;

a one end support part that supports one end of the string member;

an opposite end rotation part that is rotatably supported relative to a rotation shaft supported on the moving body; and an opposite end support part that supports an opposite end of the string-like member, wherein the one end rotation part and the one end support part are placed so that the string member extends on an extension of a line connecting the one end rotation part and the one end support part, and the opposite end rotation part and the opposite end support part are placed so that the string-like member extends on an extension of a line connecting the opposite end rotation part and the opposite end support part.

6. The medium conveying device according to claim 2 further comprising:

a closed hold part that is provided on one end of the first guide member corresponding to the another end of the second guide member; and a held part that is provided on the another end of the second guide member and that is engageable to the close hold part to hold the second guide member at the close position.

7. An image forming apparatus comprising:

an image record section that records an image on a medium; and a medium conveying device that includes:

a first guide member that guides one face of the medium to be conveyed and opposed to the one face when the medium is conveyed;

a second guide member that guides the other face of the medium and is opposed to the other face when the medium is conveyed, the second guide member being movable between a close position and an open position;

a conveying member that is provided in a conveying passage formed by the first guide member and the second guide member being at the close position in order to convey the medium in the conveying passage; and a support member that keeps the second guide member at the open position and is provided at an edge of the second guide member that extends in a direction transverse to the direction in which the medium is conveyed such that the medium crosses the edge when conveyed by the conveying member, wherein when the second guide member is at the open position, the medium in the conveying passage is removable from the conveying passage.

8. The medium conveying device according to claim 1, wherein the second guide member is configured to move between the open position and the close position by rotating the edge of the second guide member in a direction perpendicular to the direction that the medium is conveyed.

9. The medium conveying device according to claim 1, further comprising:

a rotation center formed on the edge of the second guide member to rotatably support the second guide member; and a handle provided at an edge portion of the second guide member on another edge opposite the rotation center.

10. The medium conveying device according to claim 1, further comprising:

a handle provided at a handle edge portion of second guide member, the handle edge portion being proximate to an edge that is different than the edge at which the support member is provided.

* * * * *